United States Patent [19]

Karl

[11] 4,031,904

[45] June 28, 1977

[54] REMOVABLE WATER TIGHT BASE FOR BONG

[75] Inventor: Eric Karl, Los Angeles, Calif.

[73] Assignee: Sarah's Family, Inc., Inglewood, Calif.

[22] Filed: Sept. 16, 1976

[21] Appl. No.: 723,875

[52] U.S. Cl. ..... 131/173; 215/277

[51] Int. Cl.[2] ..... A24F 1/30

[58] Field of Search ..... 131/173; 215/277, 273, 215/317, 321, 353; 220/350, 357, 358, 378

[56] References Cited

UNITED STATES PATENTS

| | | | |
|---|---|---|---|
| 3,659,736 | 2/1972 | Riggs | 215/277 |
| 3,863,646 | 2/1975 | Kahler | 131/173 |
| 3,872,872 | 3/1975 | Kahler | 131/173 |

*Primary Examiner*—Stephen C. Pellegrino
*Attorney, Agent, or Firm*—Nilsson, Robbins, Dalgarn & Berliner

[57] ABSTRACT

A removable water tight seal and base assembly for a bong or a water smoking pipe is disclosed. The smoking pipe has a tube for retaining water or other filtering substances and a sealing cap is detachably secured to the bottom of the tube with the cap and tube assembly mounted in a recess of a base which applies further pressure to seal the cap to the tube. The sealing cap has a circular rib formed on the inner surface of the flange near the mouth of the cap. Also provided is a base having a recess to receive the cap and press the rib firmly against the tube wich seals the bottom of the tube when the smoking pipe is being used. The base and cap may be easily removed to clean the tube.

7 Claims, 3 Drawing Figures

REMOVABLE WATER TIGHT BASE FOR BONG

BACKGROUND OF THE INVENTION

The present invention relates to a removable sealing cap for a water smoking pipe and more particularly to an improved smoking pipe which is readily adaptable to being cleaned.

Smoking pipes or bongs have been generally used for filtering smoke from the smoking tobacco by transmitting the smoke from the bowl where the tobacco is burned through a first pipe into a container of water which performs a filtering function. The smoke is then transmitted by suction applied by the user through the tube of the bong to the user's mouth.

Such prior art devices generally include one or more flexible hoses which have a tendency to become clogged up as a result of smoke which passes through them. The devices are typically large, bulky and difficult to maintain and clean. Often they must be discarded after extensive use. In addition to being unsanitary and complicated in their construction such devices are extremely inefficient when a user attempts to use them for smoking rare and expensive tobaccos.

More recently, smoking pipes have been developed which seek to provide simplicity in construction. Such devices are shown in U.S. Pat. Nos. 3,872,872 and 3,863,746 to Kahler. Such devices however are not readily adaptable for disassembly to enable them to be cleaned easily. Nor do they provide a sufficiently tight seal.

SUMMARY OF THE INVENTION

The present invention provides a removable water tight sealing cap and base for a water smoking pipe or bong which may be easily removed for cleaning of the smoking pipe. The smoking pipe of the present invention includes a hollow tube for maintaining the water or other filtering liquid and a removable sealing cap detachably secured to the bottom of the tube.

A further and more detailed aspect of the present invention is that the sealing cap includes a rib formed near the mouth of the inner surface of that flange of the cap for sealing the bottom of the tube. The combination of cap and tube assembly is mounted in a recess in a base for providing pressure against the flange of the cap to further seal the cap to the tube. The base also adds stability to the cap and tube assembly to stand upright while the water pipe is being used.

When the tube is mounted in the sealing cap, the flange is stretched due to the rib in the cap to cause the outer surface of the flange of the sealing cap to have a slightly frusto-conical shape. The inner surface of the recess in the base of the water pipe tapers upwardly at a draft angle in the order of 1.5° to accommodate this frusto-conical shape of the cap when the sealing cap is secured to the bottom of the tube. The water pipe may be easily cleaned by simply removing the tube and sealing cap from the base and separating the cap from the tube to clean both the cap and the tube.

DESCRIPTION OF THE PREFERRED EMBODIMENT

Figure 1:
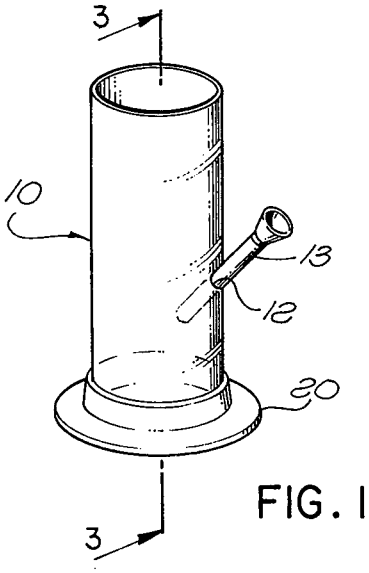
FIG. 1 is a perspective view of a water pipe adapted to use the removal seal of the present invention.
Figure 2:
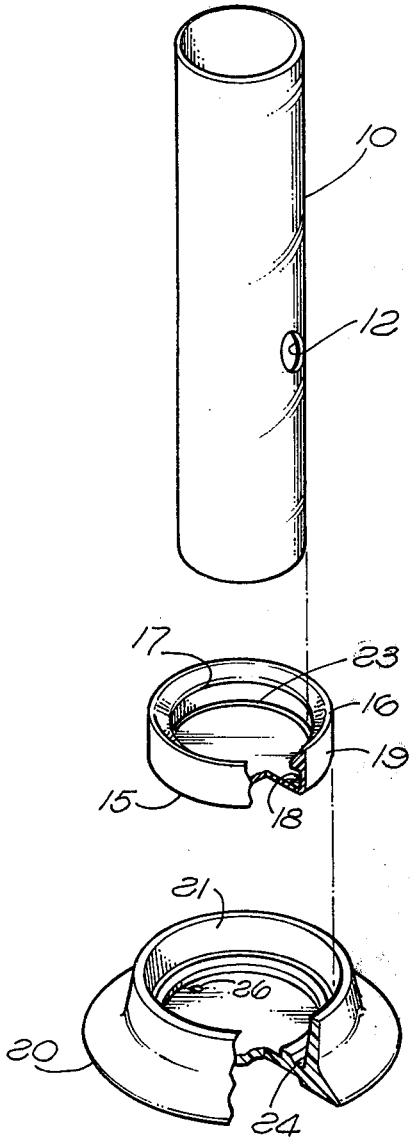
FIG. 2 is an exploded view of the present invention.

Referring to FIG. 1, there is shown the smoking pipe of the present invention having a hollow tube 10 with sealing means detachably mounted to the bottom of the tube. A base is provided in which the combination of sealing means and tube is mounted to provide further pressure to more effectively secure the sealing means against the tube as well as support for the assembly.

Figure 3:
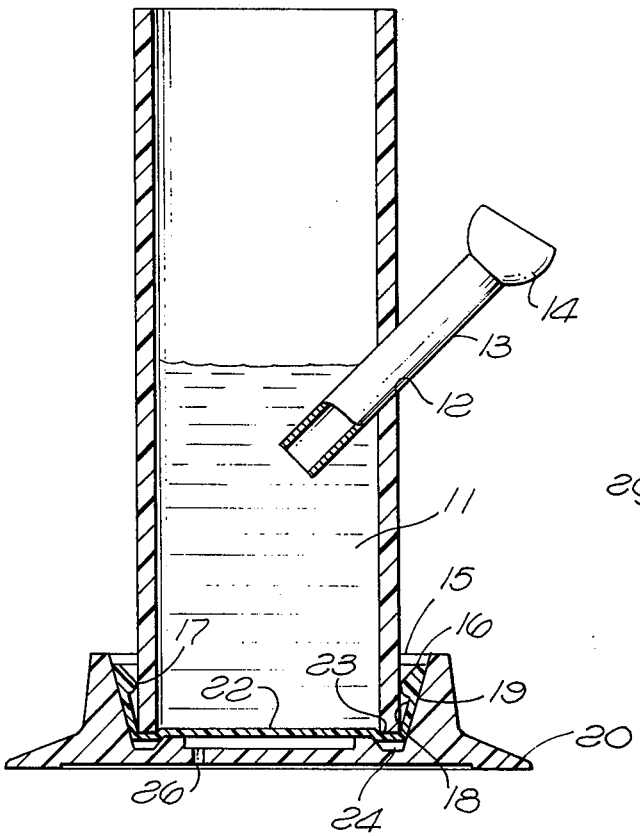
FIG. 3 is a cross-sectional view of FIG. 1 taken along the plane 3—3.

The smoking pipe includes a first hollow tube 10 for maintaining a volume of liquid 11, shown in FIG. 3, and having a opening 12 in the side thereof. A second tube 13 is fitted through the opening 12 in the tube 10 and has one end disposed in the liquid 11 and the other end communicating with the smoking tobacco (not shown).

The sealing means shown in the form of a sealing cap 15 is detachably mounted to the bottom of the tube 10 for sealing the tube 10. The sealing cap has a circumferential flange 16 and a rib 17 is formed around the mouth of the inner surface 18 of the flange for engaging the tube 10 for providing a tight seal to the bottom of the tube 10.

When the tube 10 is mounted in the sealing cap 15 the outer surface 19 of the circumferential flange assumes a frusto-conical or upwardly tapered configuration as exageratedly shown in FIG. 3.

The sealing cap 15 has a bottom surface 22 and a recessed ring 23 formed therearound in which the tube 10 is fitted. The sealing cap 15 may be formed of any suitable material such as polyethylene.

Base means is provided in the form of a base 20 having a recessed area with a wall 21 having a frusto-conical or slightly upwardly tapered shape for accommodating the sealing cap 15 having the tube 10 fitted therein. The draft angle of taper of the sealing cap with the tube 10 fitted therein as well as that of the wall 21 is in the order of 1.5° from the vertical.

The tube 10 of the sealing cap 15 mounted at the bottom thereof may be placed in the recess of the base 20 to enable the base 20 to provide additional pressure to the outer surface 19 of the flange 16 which in turn provides additional pressure to the rib 17 to further prevent any of the liquid from escaping from the bottom of the tube 10. The base also provides support for the smoking pipe assembly.

The recessed ring 23 in which the tube 10 is fitted further provides sealing to prevent the fluid 11 in the tube 10 from escaping. As shown in FIG. 3, the base 20 has a circular groove 24 for receiving and accommodating the recessed ring 23 in the bottom surface 22 of the sealing cap 15.

The base 20 also has a port 26 to relieve the pressure in the recess in the base 20 when the cap 15 having a slightly upperwardly tapered configuration on the outer surface 19 of the circumferential flange 16 is inserted into the recess of the base 20. The port 20 also prevents a vacuum when the seal 15 is withdrawn from the recess of the base 20.

In the usage of the smoking pipe or bong of the present invention, liquid 11 is poured into the tube 10 to a height above the bottom opening of the tube 13 and the tobacco is inserted in a bowl 14 and lit. The user may apply suction to the top of the tube 10 by placing his mouth there. This causes the smoke from the burning tobacco to be transmitted through the tube 13, the filtering liquid 11 and up the top of the tube 10 into the mouth of the user.

The mechanism of the present invention may be easily disassembled for cleaning by simply removing the tube 10 and the cap 15 from the base 20 and then separating the tube 10 and the cap 15.

The components of the present invention may be formed of a suitable substance and in the preferred embodiment, as indicated above, the sealing cap is formed of polyethylene. The tube 10 is preferably formed of acrylic and the base 20 is formed of polystyrene.

Obviously, many modifications and variations of the present invention are possible in light of the above teachings. It is therefore to be understood that the invention can be practiced otherwise than as specifically described.

1. A device for filtering tobacco smoke through liquid comprising:

a first hollow tube having first and second open ends and an outer surface for maintaining a volume of filtering liquid and having an opening in the side thereof;

a second smoke conducting tube disposed through the opening in said first tube having one end disposed in the filtering liquid and the other end communicating with the tobacco;

sealing means having a circumferential flange having inner and outer surfaces and a mouth and adapted for detachable mounting to the bottom of said first tube for sealing said first end of said first tube; and base means having a recess for receiving sealing means for providing additional pressure to said sealing means and for providing a support for the combination of said sealing means and said first tube.

2. The device as described in claim 1, wherein said sealing means includes a rib formed on the inner surface of said circumferential flange around the mouth thereof for engaging the outer surface of said first tube for providing tight sealing of the bottom of said first tube.

3. The device as described in claim 2, wherein said rib of said flange when said sealing means is mounted to the bottom of said tube urges said flange outwardly in the vicinity of the mouth thereof to cause the outer surface of said flange to assume a frusto-conical shaped configuration and said recess in said base means has a frusto-conical shaped configuration to accommodate the frusto-conical shaped configuration of said flange on said sealing means to provide additional pressure to said sealing means to provide a tight seal.

4. The device as described in claim 2, wherein said sealing means includes a flat surface which communicates with said filtering liquid and a recessed ring formed in said flat surface in which said first end of said first tube is fitted.

5. In a smoking device for filtering a smoking tobacco having a first tube for maintaining a volume of filtering liquid and a second tube for communicating the smoke from the tobacco through the liquid, the improvment comprising:

a sealing cap having a circumferential flange having inner and outer surfaces and a mouth, said sealing cap having a rib formed around the inner surface of said circumferential flange around the mouth thereof, whereby the first tube may be detachably fitted through the mouth of said sealing cap with the outer surface thereof against the rib formed on the inner surface of said circumferential flange, said sealing cap further including a flat surface for communicating with the liquid, whereby said outer surface of said circumferential flange assumes a slightly tapered configuration when the first tube is fitted into said sealing cap;

a base having a recess for receiving said tube and cap; and means within said base for providing additional pressure to said flange to provide a tight seal.

6. The apparatus as described in claim 5, wherein said flat surface of said sealing cap defines a recessed ring in which the first tube is fitted.

7. The apparatus as described in claim 5 wherein said means within said base includes the inner walls of said recess having a slightly outwardly tapered configuration for accommodating the outer surface of said circumferential flange of said sealing cap having the first tube fitted therein for providing additional pressure on the rib against the tube to effect a water tight seal.

* * * * *